US005456308A

United States Patent [19]

Yukumoto et al.

[11] Patent Number: 5,456,308

[45] Date of Patent: Oct. 10, 1995

[54] METHOD AND APPARATUS FOR MANUFACTURING THIN AMORPHOUS METAL STRIP

[75] Inventors: Masao Yukumoto; Hiroshi Yamane; Seiji Okabe; Masanao Midorikawa; Kenzo Ohsu, all of Chiba, Japan

[73] Assignee: Kawasaki Steel Corporation, Japan

[21] Appl. No.: 193,444

[22] Filed: Feb. 8, 1994

[30] Foreign Application Priority Data

Feb. 12, 1993 [JP] Japan ..... 5-023957
Feb. 12, 1993 [JP] Japan ..... 5-023977

[51] Int. Cl.[6] ..... B22D 11/06; B22D 11/00

[52] U.S. Cl. ..... 164/463; 164/415; 164/422; 164/475

[58] Field of Search ..... 164/463, 423, 164/415, 475

[56] References Cited

U.S. PATENT DOCUMENTS 4,649,984 3/1987 Bedell et al. ..... 164/463
4,838,341 6/1989 Bye, Jr. et al. ..... 164/463
5,301,742 4/1994 Sato et al. ..... 164/463

FOREIGN PATENT DOCUMENTS 4-356336 12/1992 Japan ..... 164/475

*Primary Examiner*—Kuang Y. Lin
*Attorney, Agent, or Firm*—Austin R. Miller

[57] ABSTRACT

A method and apparatus for manufacturing a thin amorphous metal strip. Molten metal is injected onto a single cooling roll rotating at high speed. A gas flow impeding wall is disposed adjacent to the surface of a cooling roll and extends across the body of the cooling roll. The wall is located upstream of the molten metal injection nozzle. $CO_2$ gas is jetted along one surface of the gas insulating wall which faces the molten metal injection nozzle and toward the surface of the cooling roll. An atmosphere rich in $CO_2$ gas is maintained adjacent the roll surface just upstream of the molten metal injection nozzle.

20 Claims, 6 Drawing Sheets

COMPARATIVE EXAMPLE

COMPARATIVE EXAMPLE

COMPARATIVE EXAMPLE

COMPARATIVE EXAMPLE

CONVENTIONAL APPARATUS

METHOD AND APPARATUS FOR MANUFACTURING THIN AMORPHOUS METAL STRIP

RELATED APPLICATIONS

The applicant's assignee, Kawasaki Steel Corporation, is the owner of U.S. application Ser. No. 072,778 filed Jun. 7, 1993, now abandoned and application Ser. No. 121,184 filed Sep. 14, 1993, now U.S. Pat. No. 5,392,837.

FIELD OF THE INVENTION

The present invention relates to technology for manufacturing a thin amorphous metal strip which is thicker than about 35 μm and which is adaptable to manufacturing a thin metal strip with rapid cooling using a single roll.

RELATED ART

A method of manufacturing a thin metal strip directly from molten metal has been known, the method being arranged in such a manner that the molten metal is dripped through a nozzle onto the outer surface of a cooling roll which is rotating at high speed. The foregoing method using the cooling roll is classified as either the "single roll method" or the "twin roll method."

The single roll method is suitable for manufacturing relatively wide thin metal strips. It is performed by injecting molten metal through a nozzle toward a single cooling roll which is rotating at high speed. The molten metal is rolled out thinly while being allowed to adhere to the surface of the cooling roll and it is rapidly cooled and solidified during rotation through a certain angular distance so that it is formed into amorphous metal on the roll surface. The amorphous metal is separated from the surface of the cooling roll by the centrifugal force generated when the cooling roll rotates so that the amorphous metal is formed into a thin strip.

When the thin amorphous metal strip is cast into the atmosphere rotation of the cooling roll generates a phenomenon wherein an air boundary layer is formed in an air layer that is in contact with the surface of the cooling roll. The air boundary layer is fluidized because it is being dragged by the surface of the cooling roll. The air in the air boundary layer is introduced into the space between the molten metal injected onto the cooling roll and the surface of the cooling roll. Such introduced air excessively increases the heat transfer resistance of the surface of the cooling roll, decreasing its cooling ability. Accordingly, it has been difficult to cast an amorphous thin strip thicker than 35 μm using this technique.

Referring to the drawings, particularly FIG. 11 which shows a conventional single roll apparatus, when a cooling roll 2 is rotated in the direction designated by the arrow 6, an air boundary layer 3 is formed adjacent to the surface of the cooling roll 2. Air in the boundary layer 3 is introduced into the space between the molten metal 4 injected through the nozzle 1 and the surface of the cooling roll 2, so that a layer of introduced air 5 is generated. The introduced air 5 moves downstream under the injected metal and creates a gap of about 0.1 to 5 μm between the cooling roll 2 and the molten metal 4, resulting in great resistance to heat transfer. Since the presence of the gap influences the shape of the surface of the molten metal, it causes the surface of the thin strip to be roughened as it solidifies.

In order to overcome the foregoing problem, a method of making a thick strip has been disclosed in Japanese Patent Publication No. 3-28254 in which CO gas is burnt at a position adjacent to and upstream of the molten metal from the cooling roll to lower the gas density in the gas boundary generated around the cooling roll, and to provide the portion around the molten metal with a reduced atmosphere so that the heat transfer resistance between the molten metal and the cooling roll is reduced.

However, this use of CO gas requires a multiplicity of safety precautions because CO is a toxic gas and involves risk of explosion. Therefore, CO gas cannot easily be used industrially. It also causes a cost problem.

Federal Republic of Germany Patent No. DD266046AI has disclosed a system arranged in such a manner that a puddle portion of the molten metal is sprayed with $CO_2$ gas to reduce the quantity of gas that can be introduced between the molten metal and the cooling roll.

However, this method uses flat nozzles disposed in front and to the rear of the molten metal nozzle and encounters the obstacle that the sprayed $CO_2$ gas is disordered by the gas boundary layer generated around the cooling roll. As a result, air is undesirably mixed with the $CO_2$ gas, causing the concentration of $CO_2$ to be lowered. Therefore, if the thin strip is wider than about 50 mm, for example, the effect of preventing the introduction of the gas becomes different between the central portion and the edge portions of the thin strip. With this method it is very difficult to make a rather wide thin strip which is formed uniformly in the width direction.

Japanese Patent Laid-Open No. 4-356336 has disclosed a method arranged such that a portion, in which the molten metal is injected, is covered with a chamber to provide an atmosphere of $CO_2$.

However, the single roll method requires the gap between the molten metal nozzle and the surface of the cooling roll to be strictly controlled. Therefore, use of a chamber that interrupts the control of the gap causes a problem in that the controlling system becomes too complicated.

Japanese Patent Laid-Open No. 57-159247 has disclosed an apparatus using a protective insulating wall disposed adjacent to the surface of the cooling roll so that the air boundary layer generated in contact with the surface of the cooling roll is removed. However, that apparatus again forms an air boundary layer at a position downstream from the protective insulating wall, at an extremely short distance from the molten metal nozzle, resulting in an unsatisfactory effect.

OBJECTS AND SUMMARY OF THE INVENTION

An object of the present invention is to provide a simple and safe technology using the aforementioned single roll method, assuring that gas introduction into the space between the cooling roll and molten metal is impeded to improve heat transfer between the cooling roll and the metal strip. A further object is to be able to cast a thin amorphous metal strip which is thicker than that manufactured by the conventional technology.

Another object of the present invention is to provide a technology capable of improving strip surface smoothness.

Another object of the present invention is to provide a simple easily controllable apparatus capable of casting superior thin amorphous metal strip.

According to the present invention, molten metal is injected through an injection nozzle to a single cooling roll rotating at high speed. This is done by disposing a gas impeding wall in contact with or adjacent to the surface of the cooling roll and extending across the body of the cooling roll, the gas impeding wall being located peripherally upstream of the metal injection position; and jetting $CO_2$ gas along the surface of the gas impeding wall which faces the molten metal, and causing the $CO_2$ gas to then flow toward and to the surface of the cooling roll, so that a cooling roll surface portion adjacent to and upstream of the metal injection position is maintained with an atmosphere rich in $CO_2$ gas.

As stated, the apparatus of this invention injects molten metal through an injection nozzle to a single cooling roll rotating at high speed. The apparatus comprises a gas blocking or impeding wall disposed in contact with or adjacent to the surface of the cooling roll and extending across the body of the cooling roll, the gas blocking or impeding wall being located upstream of the metal injection position. The apparatus further includes a nozzle for jetting $CO_2$ gas along that surface of the gas blocking or impeding wall which faces the molten metal injection nozzle, and for causing the $CO_2$ gas then to flow toward the surface of the cooling roll.

According to one form of the invention molten metal is, through an injection nozzle, injected to a single cooling roll rotating at high speed, and the blocking or impeding wall is a carbon blade disposed in contact with the surface of the cooling roll and extending across the body of the cooling roll, the carbon blade being located upstream of the metal injection position. An important step comprises jetting $CO_2$ gas along that surface of the carbon blade which faces toward the molten metal injection nozzle and causing the $CO_2$ then to flow toward and to the cooling roll, so that a portion of the cooling roll surface at a position upstream from the metal injection position, is maintained with an atmosphere containing a significant percentage of $CO_2$ gas.

Preferably, the gas flow impeding wall has a thickness of about 2–100 mm as measured in the circumferential direction of the cooling roll disposed upstream of the metal injection position, and is set to provide a gap above the surface of the cooling roll of about 0.05 mm to about 2 mm, and the molten metal is injected onto the cooling roll at a pressure of about 20 kPa to about 90 kPa. Preferably, the peripheral speed of the cooling roll is about 15 m/s to about 27 m/s, and a thin amorphous strip having a thickness of about 35 μm to about 100 μm is produced.

It is further preferred that the gas flow impeding wall has a thickness of about 2 mm to about 100 mm in the portion in the circumferential direction of the cooling roll disposed upstream of the metal injection position, providing a gap from the surface of the roll of about 0.05 mm to about 2 mm in the direction of the body of the cooling roll, the gas flow impeding wall being disposed at a circumferential length on the surface of the roll of about 20 mm to about 100 mm at a position upstream of the direction of rotation of the roll, as measured from the intersection of a center line of the metal injection nozzle port with the surface of the roll.

Other and further objects, features and advantages of the invention will be appear more fully from the following description.

DESCRIPTION OF THE PREFERRED EMBODIMENTS

Figure 1:
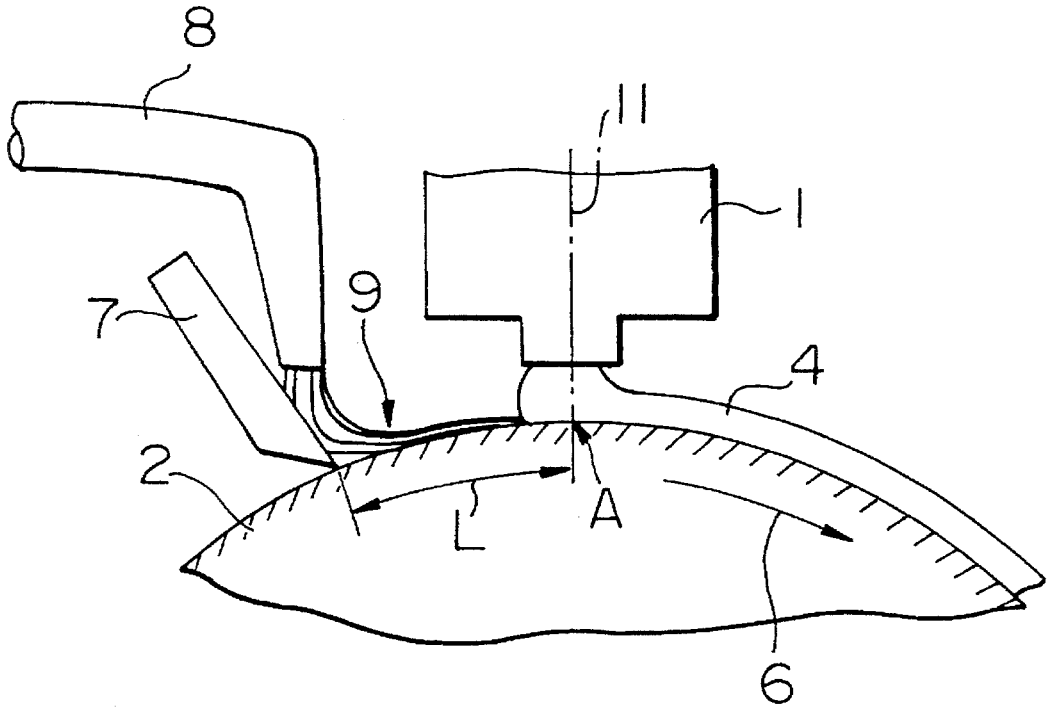
FIG. 1 is a side view which schematically illustrates an apparatus according to the present invention.

Referring to FIG. 1, a single cooling roll 2 is, in the atmosphere, rotated at high speed in the direction designated by the arrow 6. Molten metal 4 is injected from a nozzle 1 onto the cooling roll 2.

A carbon blade 7 according to this invention is disposed in contact with the surface of the cooling roll 2 at a position distant from the point A in FIG. 1, at which a central axis 11 of the nozzle 1 intersects the surface of the cooling roll 2. It is spaced at a circumferential spacing length L in a direction upstream in respect of the direction of rotation 6 of the cooling roll 2.

The carbon blade 7 impedes, blocks or prevents the introduction, into the space just upstream of nozzle 1, of the atmosphere that tends to cling to the surface of the rotating cooling roll 2. A $CO_2$ nozzle 8 is disposed adjacent to the downstream surface of the carbon blade 7. The nozzle 8 injects $CO_2$ gas 9 onto the downstream surface of the carbon blade 7 in a direction then to flow toward the surface of the cooling roll 2, as shown. The $CO_2$ gas 9 then flows in a downstream direction along the surface of the cooling roll 2, reaching the interface between the molten metal 4 and the cooling roll 2 and there provides an atmosphere of dense or relatively dense $CO_2$. Therefore, the formation of an atmospheric gap, as in the conventional structure, can be prevented, resulting in significantly improved heat transfer.

We have found that preferably the concentration of $CO_2$ gas must be about 35 vol % in the atmosphere upstream of the nozzle 1 to assist in preventing the introduction of atmospheric gas into the area. A carbon blade 7 is ideal because it exhibits excellent lubricating characteristics when applied to the cooling roll 2, and does not damage the cooling roll 2.

If the carbon blade 7 is not disposed at a position at a spacing L of about 20 mm or longer from the intersection A, longer, fine splashes that fly at the commencement of molten metal injection tend to become caught between the blade 7 and the cooling roll 2. Therefore, the roll can be damaged.

If the circumferential spacing L is longer than about 100 mm, excessive atmospheric air tends to become mixed with the $CO_2$ gas 9. In such case a gap is undesirably created in the interface between the molten metal 4 and the cooling roll 2. Since the $CO_2$ gas 9 is introduced onto the roll 2 along the carbon blade 7 it forms a layer flow and resists inflow of the surrounding atmospheric air.

In order to stably cast a thin amorphous metal strip having a thickness of about 35 μm or more, the pressure at which the molten metal is injected must be about 20 kPa to about 90 kPa and the peripheral speed of the cooling roll 2 must be about 15 m/s to about 27 m/s.

If the injection pressure is lower than about 20 kPa the contact force generated between the molten metal and the cooling roll 2 tends to be too weak to transfer heat sufficiently, and the molten metal cannot be formed effectively into the amorphous phase.

If the injection pressure is higher than about 90 kPa, the molten metal tends to flow in a direction opposing the direction of rotation of the cooling roll 2, and the casting process cannot be performed in a stable manner.

If the peripheral speed of the cooling roll 2 is less than about 15 m/s, the capability of the cooling roll 2 to cool the thin strip deteriorates and the thin strip cannot be formed into the amorphous phase. Therefore, a thin amorphous metal strip cannot be obtained.

If the cooling roll 2 is rotated at a speed higher than about 27 m/s, the flow rate of the molten metal must be increased, causing the flow of the molten metal 4 to be turbulent. In this case the resulting thin strip suffers from unsatisfactory surface characteristics.

Only when the foregoing conditions are satisfied, a thin amorphous alloy strip having a thickness of about 35 μm to about 100 μm can be obtained with excellent reproducibility. It is preferable to heat the jetted $CO_2$ to about 500° C. or higher. The nozzle 1 which may be in the form of slits formed at intervals of about 2 mm or less, which must often be heated to prevent clogging of the nozzle 1. If the $CO_2$ gas is heated to about 800° C. or higher, the size of the heating apparatus is considerable and the required heating energy increases excessively.

If the carbon blade 7 is in contact with the surface of the cooling roll 2 in a case where the casting process is performed in a large-size apparatus for a long time, particles of fine dust or chips of the thin strip tend to intrude between the carbon blade 7 and the surface of the cooling roll 2, damaging the surface of the cooling roll. In order to prevent this contact between the gas flow impeding wall 7 and the cooling roll 2 should be prevented and the air flows generated on the surface of the cooling roll removed.

Figure 7:
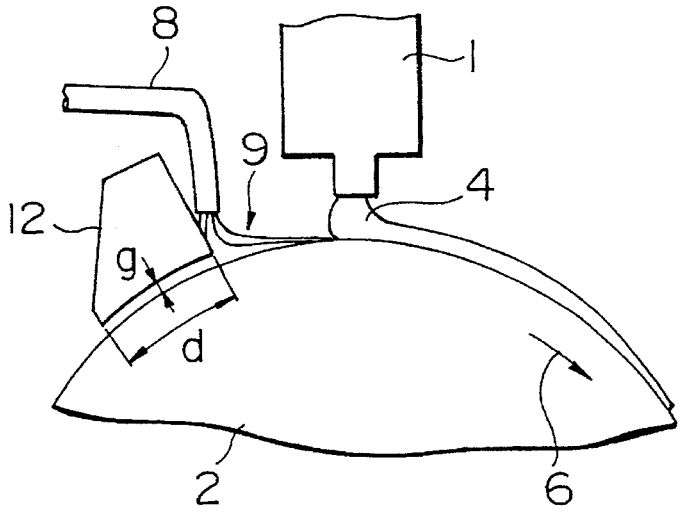
FIG. 7 is a side view which schematically illustrates another embodiment of the present invention.

The foregoing requirements are well satisfied in the embodiment of the invention shown in FIG. 7, wherein a gas impeding wall 12 is provided in place of a carbon blade 7. The thickness d of that portion of the gas impeding wall 12 that faces the surface of the cooling roll 2 is about 2 mm to about 100 mm. Further, the gap g between the gas insulating wall 12 and the surface of the cooling roll 2 must be about 0.05 mm to about 2 mm to obtain a satisfactory effect.

In order to effectively impede the air flow, the thickness d of the gas insulating wall 12 facing the surface of the cooling roll 2 must be more than about 2 mm and the gap from the surface of the cooling roll 2 must be about 2 mm or less. If the thickness d of the portion facing the surface of the cooling roll 2 is about 100 mm or more, the force of the air flow which tends to move when the cooling roll 2 is rotated and which drags against the gas impeding wall 12, is enlarged. This presents a risk that contact of wall 12 with the surface of the cooling roll 2 will take place.

If the gap g is about 0.05 mm or less, dust and chips of thin strip may be unable to pass through the gap g and may damage the surface of the cooling roll 2. If the gas impeding wall 12 is not disposed at the peripheral length L of about 20 mm or longer from the intersection A between the central line of the nozzle 1 in the upstream direction, fine splashes of the molten metal flying during molten metal injection may be undesirably introduced between the gas impeding wall 12 and the cooling roll 2. In this case the cooling roll 2 can be damaged.

Any necessity of forming a bottom surface of the gas impeding wall can be eliminated. It is preferable to form rectangular or sawtooth-like recesses in the bottom surface of the wall 12 extending across the body of the cooling roll 2 to improve the effect of impeding air flow.

Figure 8:
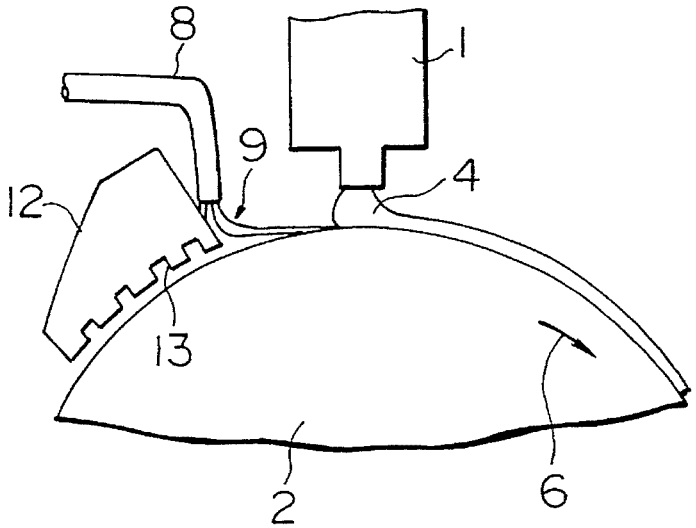
FIG. 8 is a side view which schematically illustrates still another embodiment of the present invention.

FIG. 8 illustrates an example in which rectangular grooves 13 are provided across the bottom surface of the gas impeding wall 12 and extending across the surface of the cooling roll 2 parallel to its axis of rotation.

It is preferable that the surface of the roll 2 be sprayed with the $CO_2$ gas jetted out through the bottom surface of the gas flow impeding wall 12. This improves the effect of retarding the air flow.

Figure 9:
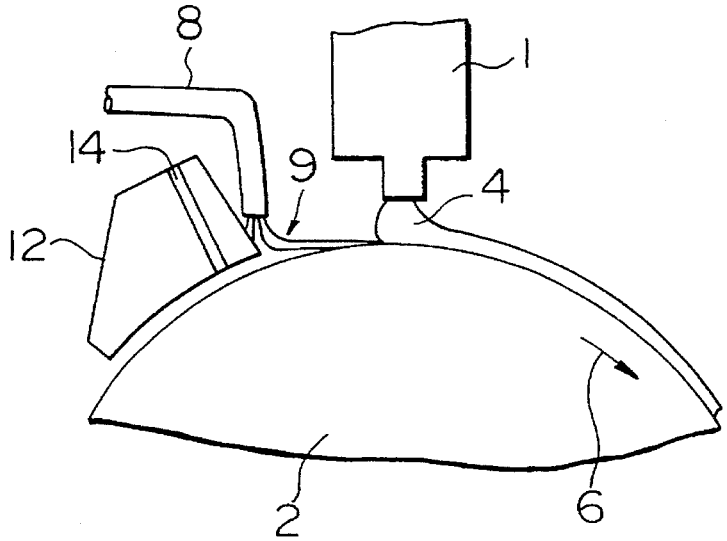
FIG. 9 is a side view which schematically illustrates yet another embodiment of the present invention.

FIG. 9 illustrates an example in which a laterally-extending gas jet port 14 is provided for jetting $CO_2$ gas through the bottom surface of the gas flow impeding wall 12.

Since the present invention enables the casting process to be performed in the atmosphere without requiring complicated apparatus, manufacturing cost is significantly reduced. Since the lateral directional portions of the nozzle 1 and the portion downstream of the rotation of the cooling roll 2 are opened, the gap between the nozzle 1 and the cooling roll 2 can easily be measured and controlled.

Since the $CO_2$ gas is carried in a downstream direction along the surface of cooling roll 2 when the cooling roll 2 is rotated, no undesirable cooling effect is generated at the nozzle 1 due to flow of the $CO_2$ gas. Therefore, clogging of the nozzle 1 with metal is not a problem.

The results of various experiments performed by the inventors will now be described. These are intended to be illustrative, and not to limit the scope of the invention.

A single cooling roll was used to perform the experiments for manufacturing thin metal strip under the following conditions.

Cooling Roll:

diameter 300 mm width 70 mm material copper alloy

Composition of Molten Metal:

B: 3.0 wt. %

Si: 5.3 wt. %

Balance: Fe

Nozzle for Injecting Molten Metal:

Slit Interval: 0.7 mm

Slit Width: 10 mm

Gap g Between Cooling Roll and Nozzle: 0.25 mm

Experiment (1)

Five methods as shown in FIGS. 1, 2, 3, 4 and 5 were employed to jet out the $CO_2$ gas.

FIG. 1 illustrates an example of the present invention, and FIGS. 2 to 5 illustrate comparative examples in which various positions and directions of the nozzle 8 for jetting $CO_2$ gas and $CO_2$ gas flow 9 were used.

Figure 2:
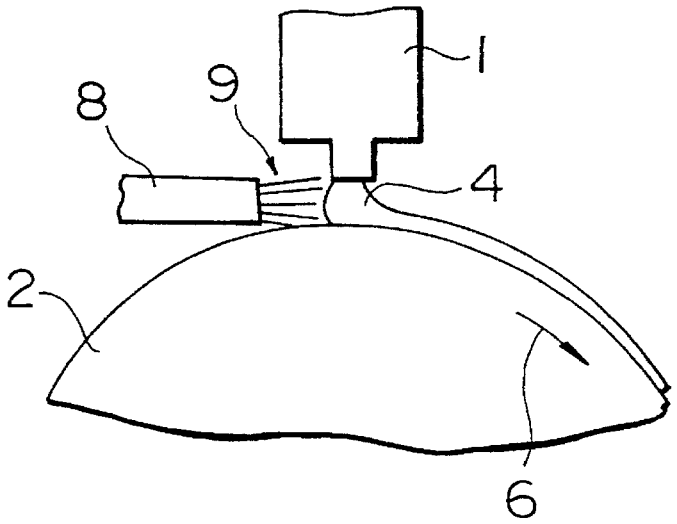
FIG. 2 is an explanatory view which illustrates a comparative example of a method of jetting $CO_2$ gas.
Figure 3:
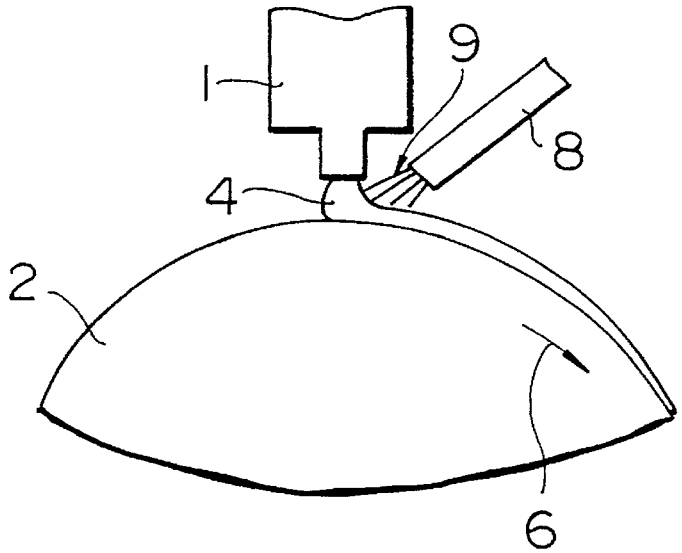
FIG. 3 is an explanatory view which illustrates another comparative example of a method of jetting $CO_2$ gas.
Figure 4:
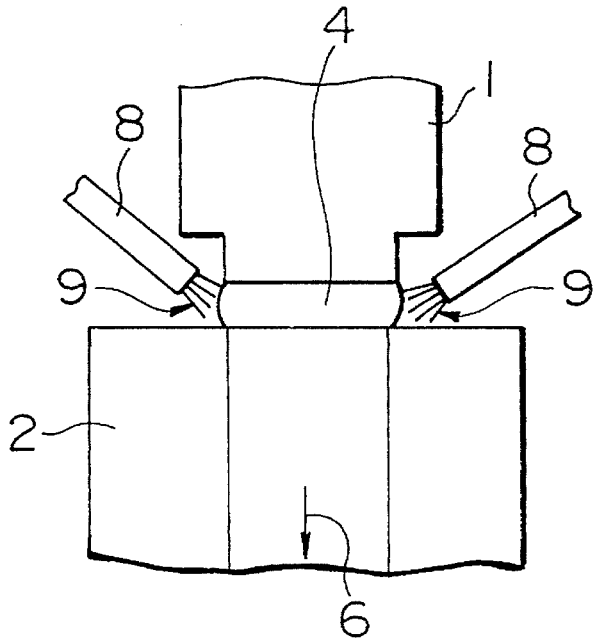
FIG. 4 is an explanatory view which illustrates still another comparative example of a method of jetting $CO_2$ gas.
Figure 5:
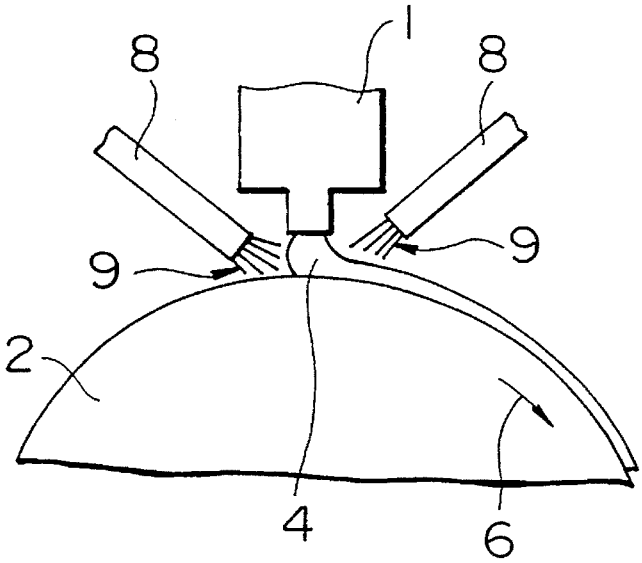
FIG. 5 is an explanatory view which illustrates yet another comparative example of a method of jetting $CO_2$ gas.

FIG. 2 illustrates a structure in which the molten metal jet was sprayed directly with the $CO_2$ gas from upstream, FIG. 3 illustrates a structure in which the molten metal jet was sprayed directly with $CO_2$ gas from a downstream position, FIG. 4 illustrates a structure in which the molten metal jet was sprayed with $CO_2$ gas from two opposed side positions, and FIG. 5 illustrates a structure the in which the molten metal jet was sprayed with $CO_2$ gas from opposed rear and front positions. Reference numerals in the foregoing figures represent the same elements as shown in FIG. 1.

The peripheral speed of the cooling roll was set to 21 m/s, and the $CO_2$ gas was jetted out through a nozzle having a diameter of 10 mm at a pressure of 400 kPa at a flow rate of 25 liters/minute. The resulting strips were tested for brittleness.

The resulting ratio of brittleness of the thin strips was as follows: the structure shown in FIG. 1 resulted in 0% brittleness ratio; the structure shown in FIG. 2 resulted in 60%, FIG. 3 55%, FIG. 4 70%, and FIG. 5 10%.

The foregoing brittleness ratio was defined and determined as follows:

20 specimens of thin strip were prepared and each specimen was bent by 180°. In these experiments, 10 specimens were bent as the sides facing the cooling roll 2 being positioned inside, and the residual 10 specimens were bent as the sides facing the cooling roll 2 being positioned outside. The ratio of the broken thin strips to the total number of strips tested was the brittleness ratio.

Experiment (2)

The peripheral spacing or length L of FIG. 1 was varied from 5 mm to 110 mm. Further, the peripheral speed of the roll was set to 21 m/s, the $CO_2$ gas was jetted out through a nozzle having a diameter of 10 mm under a pressure of 400 kPa and at a flow rate of 25 liters/minute.

When L was about 5 mm or more and less than 20 mm, fine splashes of the molten metal generated in the early stage of the process were forcibly introduced into the space between the carbon blade 7 and the roll 2. As a result, the roll 2 was damaged and a recess was formed at a position corresponding to the damaged position.

When L was longer than about 100 mm the thin strips became brittle at a ratio ranging from 10 to 15%.

When L was about 20 mm or longer and shorter than about 100 mm, amorphous metal structures free from brittleness were obtained. In particular, stable results were obtained when L ranged from about 30 to 50 mm.

Experiment (3)

The structure shown in FIG. 1 was controlled under the following conditions: L was 40 mm, the $CO_2$ gas pressure was 400 kPa at a flow rate of 25 liters/minute through a nozzle having a diameter of 10 mm, the molten metal was injected under a pressure of 10 kPa to 100 kPa and the peripheral speed of the roll was 10 m/s to 30 m/s.

Figure 6:
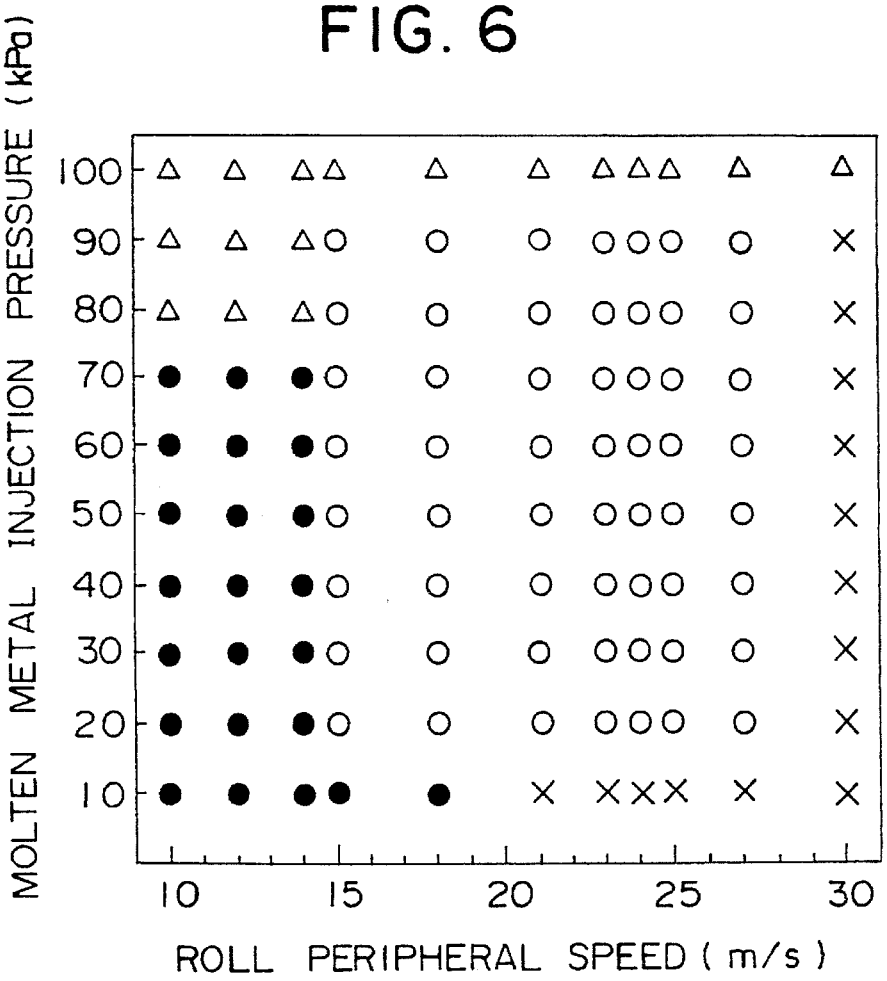
FIG. 6 is graph which illustrates a relationship among the peripheral speed of the roll, the molten metal injection pressure, the thickness of a thin strip, brittleness and instability of casting.

The results are shown in FIG. 6. Symbols shown in FIG. 6 represent the following:

A: the molten metal flowed in a direction opposing the direction of rotation of the roll

•: brittleness took place if the thin strip was about 35 μm or thicker x: the thickness of the thin strip was less than about 35 μm Experiment (4)

The structure shown in FIG. 1 was controlled as follows to cast thin strips under the following conditions: the peripheral speed of the roll was 21 m/s, the pressure at which the molten metal was injected was 24 kPa, and the $CO_2$ gas was jetted out through a nozzle having a diameter of 10 mm under a pressure of 400 KPa at a flow rate of 25 liters/minute. Further, thin strips cast by a conventional method using no carbon blade and no $CO_2$ gas nozzle. The average roughness Ra on the center line of the two types of the thin strips adjacent to the cooling roll were subjected to a comparison. The conventional method resulted in Ra values of 1.0 to 1.2 μm, while the thin strips according to the present invention resulted in Ra values of 0.3 to 0.4 μm.

In experiments (1) to (4) the process of manufacturing the thin strips by the apparatus shown in FIG. 1 sometimes encountered clogging of the nozzle for injecting the molten metal, and therefore formation of the thin strip was partially interrupted, resulting in cracks of the thin strip. However, the process in which the $CO_2$ gas was heated to 500° C. to 750° C., prevented clogging of the nozzle. When the $CO_2$ gas was heated to about 300° to 490° C., the frequency of nozzle clogging was reduced as compared with the process in which the $CO_2$ gas was at room temperature. However, the nozzle clogging could not perfectly be prevented.

Experiment (5)

A single cooling roll was used to perform experiments under the following conditions to manufacture a wide thin strip for a long time.

Cooling Roll:

diameter 1000 mm width 400 mm material: copper alloy internal water-cooling type roll Composition of Molten Metal:

B: 3.0 wt. %

Si: 5.3 wt. %

Balance: Fe

Nozzle for Injecting Molten Metal:

Slit Interval: 0.7 mm

Slit Width: 200 mm

Gap Between Cooling Roll and Nozzle: 0.25 mm

The $CO_2$ gas was jetted out in the apparatus shown in FIG. 7, so that thin strip was manufactured.

The peripheral speed of the cooling roll 2 was set to 21 m/s and the $CO_2$ gas was jetted output thorough a nozzle having a width of 240 mm.

When the thin strip was manufactured by the apparatus shown in FIG. 1, continuously for 10 minutes or longer, the surface of the thin strip facing the roll 2 was sometimes damaged in a continuous way in the lengthwise direction.

The reason for this was found to be that foreign matter was undesirably introduced between the carbon blade 7 and the roll 2 and damaged the surface of the roll 2 and the damage was transcribed to the thin strip.

In contrast with this, the process shown in FIG. 7 resulted in no damage to the surface of the roll even when the continuous run lasted longer than 10 minutes, and even when it was continued for 30 minutes. As a result, the manufacturing run was stably and advantageously performed.

Experiment (6)

The apparatus shown in FIG. 7 was used while making the thickness d of the gas insulating wall 12 in the range of 10 to 60 mm, and changing the gap g between the gas wall 12 and the roll 2 from 0.03 mm to 5 mm. As a result, thin amorphous alloy strips free from brittleness were stably and effectively obtained when the gap g ranged from about 0.05 mm to 2 mm.

When the experiment was performed with the gap g between the wall 12 and the roll 2 at 0.2 to 1 mm and the thickness d of the insulating wall at 0.5 to 180 mm, no thin strip free from brittleness was obtained when the thickness d of the wall 12 was smaller than 2 mm. When the thickness d of the wall 12 was larger than 100 mm, vibrations took place in the wall 12, causing the wall 12 to be brought into contact with the roll 2. In the foregoing case, the thin strip could not stably be manufactured.

As can be understood from Experiment (6), the apparatus shown in FIG. 7 can be continued for a long time under condition that the gas impeding wall having the thickness d of about 2 mm or more and about 100 or less along the circumferential direction of the cooling roll 2 is disposed in such a manner that the gap g between the wall 12 and the surface of the roll 2 is about 0.05 mm or more and about 2 mm or less.

Experiment (7)

Figure 10:
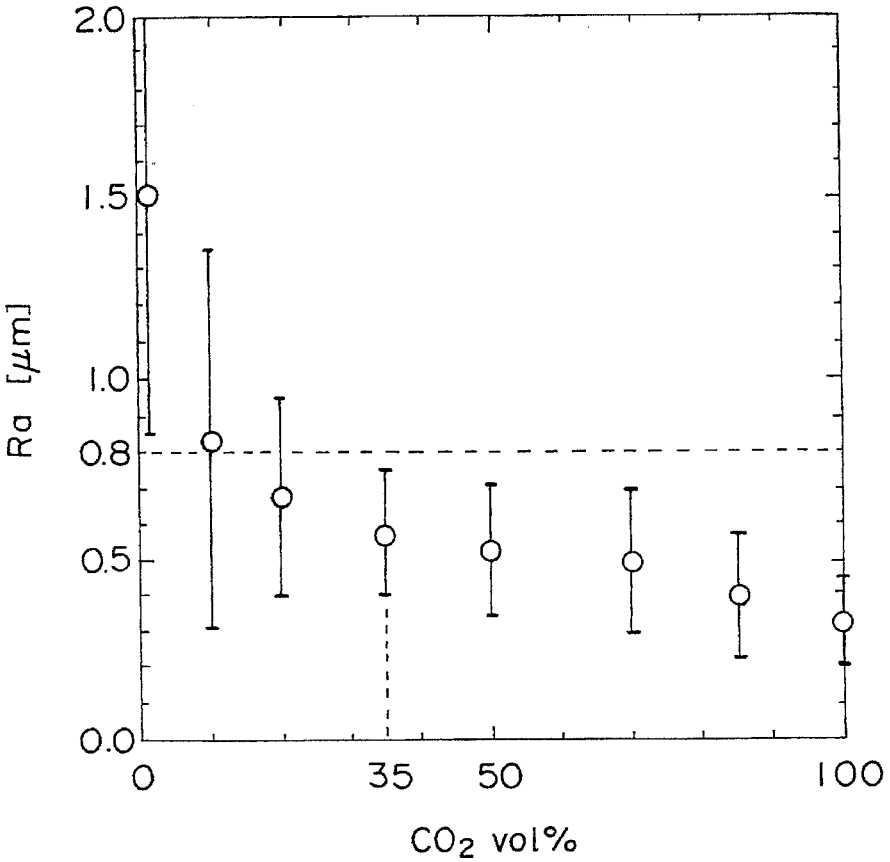
FIG. 10 is a graph which illustrates a relationship between the concentration of $CO_2$ around a puddle and the surface roughness of a thin strip facing a cooling roll.
Figure 11:
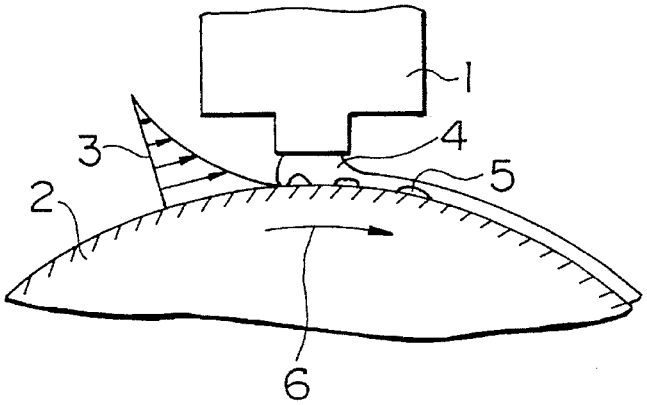
FIG. 11 is a side view which schematically illustrates a conventional apparatus.

As shown in the drawing the relation shown in FIG. 10 was held between the concentration of the $CO_2$ gas around the puddle of molten metal injected onto the cooling roll 2 and the surface roughness (Ra) of the manufactured thin metal strip.

FIG. 10 illustrates the surface roughness (Ra) of the thin strip which comes in contact with the cooling roll in such a manner that the flow rate of the jetted $CO_2$ gas and $CO_2$ vol % around the puddle was changed in the following cases: (a) L as shown in FIG. 1 was 40 mm; and (b) L was 40 mm, d was 20 mm and g was 3 mm in the structure shown in FIG. 7.

As can be understood from FIG. 10, the surface roughness of the thin strip is less than 0.8 μm in a region in which the $CO_2$ vol % is about 35% or higher and therefore a thin strip exhibiting surface characteristics superior to the use of atmospheric air ($CO_2$ vol %=0%) can be manufactured.

Since the present invention is arranged in such a manner that the $CO_2$ gas is caused to flow to the molten metal present on the roll while reducing or eliminating admixture of air with the $CO_2$ gas, generation of a gap in the interface between the roll and the molten metal due to the presence of the gas can be prevented. Further, the optimized casting conditions were found to have reduced the resistance to heat transfer of the molten metal and the roll, and to have improved the heat transfer. As a result, a quality thin amorphous strip thicker than that manufactured by the conventional method could readily be manufactured for the first time. The surface roughness of the thin strip was also significantly improved. Further, the apparatus according to the present invention is a simple apparatus capable of operating at reduced cost and is easily controlled because the structure size is readily reduced and the structure simplified.

Although this invention has been described in its preferred forms with a certain degree of particularity, it will be understood that the disclosures of preferred forms can be changed in many ways as to details of construction; various combinations and arrangements of parts may be resorted to without departing from the spirit and the scope of the invention as hereinafter claimed.

What is claimed is:

1. In a method of manufacturing a thin amorphous metal strip wherein molten metal is injected through an exposed molten metal injection nozzle against the surface of a single cooling roll rotating in a given direction, and wherein said roll is rotated at such a high speed that an undesirable layer of atmospheric gas tends to cling to the cooling roll surface and rotate with said roll, the method for producing superior strip notwithstanding the existence of said layer, which comprises:

(a) disposing a flow impeding wall adjacent to the surface of said cooling roll and extending across the body of said cooling roll to obstruct said atmospheric gas layer, said wall having a surface facing toward said injection nozzle, said wall being spaced upstream relative to the direction of rotation of said cooling roll from said molten metal injection nozzle with no part of said wall extending peripherally beyond the position of said metal injection nozzle, (b) jetting $CO_2$ gas along said surface of said wall which faces toward said molten metal injection nozzle while also directing flow of said $CO_2$ gas toward the surface of said cooling roll, thereby maintaining an atmosphere rich in $CO_2$ in the area adjacent said cooling roll and upstream of said injection nozzle to improve heat transfer between the cooling roll and the metal strip.

2. The method defined in claim 1 wherein said wall is a carbon blade closely spaced from the surface of said cooling roll.

3. The method defined in claim 1 wherein said wall is a gas impeding wall spaced from the surface of said cooling roll.

4. The method defined in claim 3 including the further step of jetting a $CO_2$ gas through said wall and onto the surface of said cooling roll.

5. The method defined in claim 1 wherein said wall is a carbon blade in contact with the surface of said cooling roll.

6. The method defined in claim 1, wherein said wall is a gas-impeding wall having recesses across the bottom surface extending across the surface of said cooling roll.

7. A method according to any of claims 1–4 or 5, wherein said molten metal is injected onto said cooling roll at a pressure of about 20 kPa to about 90 kPa wherein the peripheral speed of said cooling roll is about 15 m/s to about 27 m/s and wherein said a thin amorphous strip has a thickness of about 35 μm to about 100 μm.

8. A method according to any of claims 1–4 or 5 wherein the concentration of said $CO_2$ gas around said molten metal as injected onto said cooling roll is controlled to be about 35 vol % or higher.

9. A method according to any of claims 1–4 or 5 wherein said $CO_2$ gas is heated to about 500° C. to 800° C.

10. A method according to claim 3 or 4, wherein said wall has a thickness of about 2 mm to about 100 mm in a direction upstream of said molten metal injection nozzle; said wall having a gap from the surface of said roll of about 0.05 mm to about 2 mm, wherein said molten metal is injected onto said cooling roll at a pressure of about 20 kPa to about 90 kPa; and wherein the peripheral speed of said cooling roll is about 15 m/s to about 27 m/s; and wherein said thin amorphous strip has a thickness of about 35 μm to about 100 μm.

11. A method according to claim 10, wherein the concentration of said $CO_2$ gas around said molten metal injected onto said cooling roll is about 35 vol % or higher.

12. A method according to claim 10, wherein said wall is a carbon blade and $CO_2$ gas is injected along a surface of said carbon blade which faces said molten metal injection nozzle and is also injected toward the surface of said cooling roll, and is heated to about 500° C. to 800° C.

13. An apparatus for manufacturing a thin amorphous metal strip in such a manner that molten metal is injected through an exposed molten metal injection nozzle to a single cooling roll rotating at high speed, said apparatus comprising:

(a) a gas impeding wall disposed adjacent to the surface of said cooling roll to obstruct an atmospheric gas layer clinging to the surface of said cooling roll, said wall being spaced upstream of said injection nozzle and having a surface facing toward said molten metal injection nozzle with no part of said wall extending peripherally beyond the position of said metal injection nozzle; and (b) a $CO_2$ jet nozzle positioned for jetting $CO_2$ gas along said surface of said wall which faces toward said molten metal injection nozzle, and to direct said $CO_2$ gas to flow toward the surface of said cooling roll thereby maintaining an atmosphere rich in $CO_2$ in the area adjacent said cooling roll and upstream of said injection nozzle to improve heat transfer between the cooling roll and metal strip.

14. The apparatus defined in claim 13 wherein said wall is a carbon blade disposed adjacent the surface of said cooling roll, said carbon blade being spaced upstream of said molten metal injection nozzle.

15. The apparatus defined in claim 13 wherein said gas impeding wall is spaced from the surface of said cooling roll.

16. The apparatus defined in claim 15 wherein said gas impeding wall includes jet means for jetting a $CO_2$ gas through said wall and onto the surface of said cooling roll.

17. An apparatus according to claim 13, wherein said gas impeding wall is disposed at a circumferential spacing relative to the surface of said roll of about 20 mm to about 100 mm upstream of the intersection of the center line of said molten metal injection nozzle and the surface of said cooling roll.

18. An apparatus according to claim 15 or 16, wherein said wall has a thickness of about 2 mm to about 100 mm as measured in the circumferential direction of said cooling roll upstream of said molten metal injection nozzle, said wall having a gap from the surface of said roll of about 0.05 mm to about and 2 mm, said wall being disposed at a circumferential distance along the surface of said roll of about 20 mm to about 100 mm at a position upstream of the intersection of a center line of said molten metal injection nozzle with the surface of said roll.

19. An apparatus according to claim 13 further comprising means for heating said $CO_2$ gas for injection toward the surface of said roll to about 500° C. to about 800° C.

20. The method defined in claim 13, wherein said wall is a gas-impeding wall having recesses across the bottom surface extending across the surface of said cooling roll.

* * * * *

UNITED STATES PATENT AND TRADEMARK OFFICE

CERTIFICATE OF CORRECTION

PATENT NO. : 5,456,308

DATED : October 10, 1995

INVENTOR(S) : Masao Yukumoto et al

It is certified that error appears in the above-indentified patent and that said Letters Patent is hereby corrected as shown below:

In Column 7, Line 64, delete "A" and substitute --Δ--.

Signed and Sealed this

Twentieth Day of February, 1996

*Attest:*

*Attesting Officer*

Bruce Lehman

BRUCE LEHMAN

*Commissioner of Patents and Trademarks*